US009227307B2

(12) United States Patent
Chen

(10) Patent No.: US 9,227,307 B2
(45) Date of Patent: Jan. 5, 2016

(54) REVERSIBLE RATCHET WRENCH

(71) Applicant: Wei-Chu Chen, Yunlin (TW)

(72) Inventor: Wei-Chu Chen, Yunlin (TW)

( * ) Notice: Subject to any disclaimer, the term of this patent is extended or adjusted under 35 U.S.C. 154(b) by 360 days.

(21) Appl. No.: 13/846,422

(22) Filed: Mar. 18, 2013

(65) Prior Publication Data

US 2014/0260820 A1 Sep. 18, 2014

(51) Int. Cl.
*B25B 13/46* (2006.01)
*B25B 15/04* (2006.01)

(52) U.S. Cl.
CPC ..... *B25B 13/463* (2013.01); *B25B 13/462* (2013.01); *B25B 15/04* (2013.01)

(58) Field of Classification Search
CPC .. B25B 13/463; B25B 23/0035; B25B 13/46; B25B 13/465; B25B 15/04
USPC ..... 81/60–63.2
See application file for complete search history.

(56) References Cited

U.S. PATENT DOCUMENTS 5,957,009 A * 9/1999 McCann ..... 81/63.2
7,353,735 B2 * 4/2008 Patel et al. ..... 81/63
2003/0192408 A1 * 10/2003 Garg ..... 81/63.2

* cited by examiner

*Primary Examiner* — Robert Scruggs
(74) *Attorney, Agent, or Firm* — Che-Yang Chen; Law Office of Michael Chen

(57) ABSTRACT

A reversible ratchet wrench includes a wrench body, one end of which having a ratchet portion that has an activating opening and a circular hole, and an arc ratchet slot formed therebetween; a control unit having a circular plate portion, one end of which extending to form a handle unit, while the other end of which forming a block unit, and a U-shaped base formed at the top portion of the block unit and a spring is disposed at the U-shaped base; a ratchet unit, one end which having arc teeth, the other end of which having a protruding restricting portion, and a column protrudingly extending from one end of the restricting portion; and a rotating unit disposed at the activating opening of the wrench body, and a teeth ring formed at outer periphery of the rotating unit to engage with the arc teeth of the ratchet unit.

5 Claims, 7 Drawing Sheets

REVERSIBLE RATCHET WRENCH

FIELD OF THE INVENTION

The present invention relates to a ratchet wrench structure, and more particularly to a reversible ratchet wrench that can achieve the goal of strengthening the structure wrench and enhancing stability thereof.

BACKGROUND OF THE INVENTION

FIG. 9 shows a conventional ratchet wrench (50) including a rotating unit (60) on one end to rotate the wrench (50) to tighten or loosen a nut or bolt. A teeth ring (61) is formed outside the rotating unit (60), one side of which has a corresponding ratchet unit (70), and the ratchet unit (70) can move in a first receiving space (51) inside the wrench (50). An arc surface (71) is formed on the other surface of the rotating unit (60), and a second receiving space (52) is communicating with the first receiving space (51). A control block (80) is in the second receiving space (52) and a plugging hole (81) is on the control block (80). A spring (82) is disposed on the control block (80) and a cover (83) is formed at the top portion of the spring (82), so the cover (83) can be pushed by the spring (82) to be against the arc surface (71) of the ratchet unit (70). With the control block (80) controlling the cover (83) to push the ratchet unit (70) to different sides of the first receiving space (51), a unidirectional driving effect can be generated.

However, the conventional ratchet wrench structure has some disadvantages: (i) the spring (82) and the cover (83) are disposed between the ratchet unit (70) and the control block (80), and one side of the cover (83) is pushed by the spring (82), and the other side is against the arc surface of the ratchet unit (70). When the wrench (50) is operated to shake the ratchet unit (70) or the control block is operated to switch, one end of the cover (83) moves to the arc surface (71) of the ratchet unit (70), and the other end moves to the plugging hole (81), the cover (83) and spring (82) can be easily deformed or pops out from the plugging hole (81); (ii) the control block (80) is disposed in the second receiving space (52) and secured the control block (80) to restrict the control block (80) to only rotate. Furthermore, the spring (82) is plugging into the plugging hole (81) through the first receiving space (51), and the top portion of the spring (82) covers the cover (83). Since the opening of the first receiving space (51) is facing the rotating unit (60), it is difficult to install the spring (82). Also, the spring (82) and cover (83) are small, they may be missing during the assembly process to further increase the difficulty during the assembly process; and (iii) the spring (82) and the cover (83) are disposed between the ratchet unit (70) and the control block (80), and one end of the cover (83) is pushed by the spring (82), while the other end thereof is pressed against the arc surface (71) of the ratchet unit (70). When the ratchet unit (70) is operated, the cover can push the spring (82), so a space for the ratchet unit (70) can be maintained between the ratchet unit (70) and the control block (80) and the cover (83) and spring (82) will be over-protruding from the plugging hole (81) to adversely affect the positioning of the cover (83) and spring (82). Therefore, there will still be a need for a new and improved ratchet wrench structure to overcome the problems presented above.

SUMMARY OF THE INVENTION

The present invention is to provide a new and improved ratchet wrench structure to solve the problem presented above. The ratchet wrench structure may include a wrench body, a control unit, a ratchet unit and a rotating unit. One end of the wrench body has a ratchet portion which has an activating opening and a circular hole, and an arc ratchet slot is formed between the activating opening and circular hole. Furthermore, a fixed slot is formed at inner portion of the activating opening. A control unit has a circular plate portion, one end of which extends to form a handle unit, while the other end of which forms a block unit. A U-shaped base is formed at the top portion of the block unit and a spring is formed at the U-shaped base, and a restricting gap is recessedly formed between the circular plate portion and the U-shaped base. The control unit is disposed at the circular hole of the wrench body to expose the handle unit, and the U-shaped base of the control unit and the restricting gap are facing the ratchet slot. A positioning hole is formed at the opening of the U-shaped base of the control unit to secure the spring. One end of the ratchet unit has arc teeth, the other end of which has a restricting portion, and a column protrudingly extends from one end of the restricting portion, and the restricting portion and the column are either formed as one unit or secured in a plugging manner. The ratchet unit is disposed in the ratchet slot of the wrench body and the arc teeth of the ratchet unit faces the activating opening, and the restricting portion is disposed in the restricting gap of the control unit and the column is against the spring of the control unit. U-shaped base forms an arc surface at outer periphery of the spring, and the ratchet unit forms an arc space near the column, so an evading effect between the ratchet unit and the U-shaped base is generated using the arc space and the arc surface. A ring slot is recessedly formed at outer periphery of the rotating unit and a C-shaped conjugating unit is conjugated with the ring slot, and the C-shaped conjugating unit conjugates with the fixed slot of the activating opening to secure the wrench body and the rotating unit. A teeth ring is formed at the outer periphery of the rotating unit to engage with the arc teeth of the ratchet unit.

A main objective of the present invention is that the column is formed at the restricting portion of the ratchet unit, and the column is against one end of the spring to link the ratchet unit and the control unit; and both sides of the spring are blocked by the U-shaped base, so when the control unit is operated, the spring will not be deformed or pops out to enhance the stability of the structure.

A second objective of the present invention is that the spring is directly plugged into the positioning hole of the control unit and the U-shaped base blocks both sides of the spring, so the block unit of the control unit can be inserted into the circular hole of the wrench body. Also, the ratchet unit is disposed into the ratchet slot through the activating opening, the restricting portion of the ratchet unit plugs into the restricting gap of the control unit, and the column is against one end of the spring to easily complete the assembly process of the wrench body.

Another objective of the present invention is that the U-shaped base forms an arc surface at outer periphery of the spring, and the ratchet unit forms an arc space near the column, so an evading effect between the ratchet unit and the U-shaped base is generated using the arc space and the arc surface. Namely, the distance between the ratchet unit and the control unit is shortened, so that the U-shaped based can be used to block both sides of the column to enhance the positioning effect of the ratchet unit.

DETAILED DESCRIPTION OF THE INVENTION

The detailed description set forth below is intended as a description of the presently exemplary device provided in accordance with aspects of the present invention and is not intended to represent the only forms in which the present invention may be prepared or utilized. It is to be understood, rather, that the same or equivalent functions and components may be accomplished by different embodiments that are also intended to be encompassed within the spirit and scope of the invention.

Unless defined otherwise, all technical and scientific terms used herein have the same meaning as commonly understood to one of ordinary skill in the art to which this invention belongs. Although any methods, devices and materials similar or equivalent to those described can be used in the practice or testing of the invention, the exemplary methods, devices and materials are now described.

All publications mentioned are incorporated by reference for the purpose of describing and disclosing, for example, the designs and methodologies that are described in the publications that might be used in connection with the presently described invention. The publications listed or discussed above, below and throughout the text are provided solely for their disclosure prior to the filing date of the present application. Nothing herein is to be construed as an admission that the inventors are not entitled to antedate such disclosure by virtue of prior invention.

Figure 1:
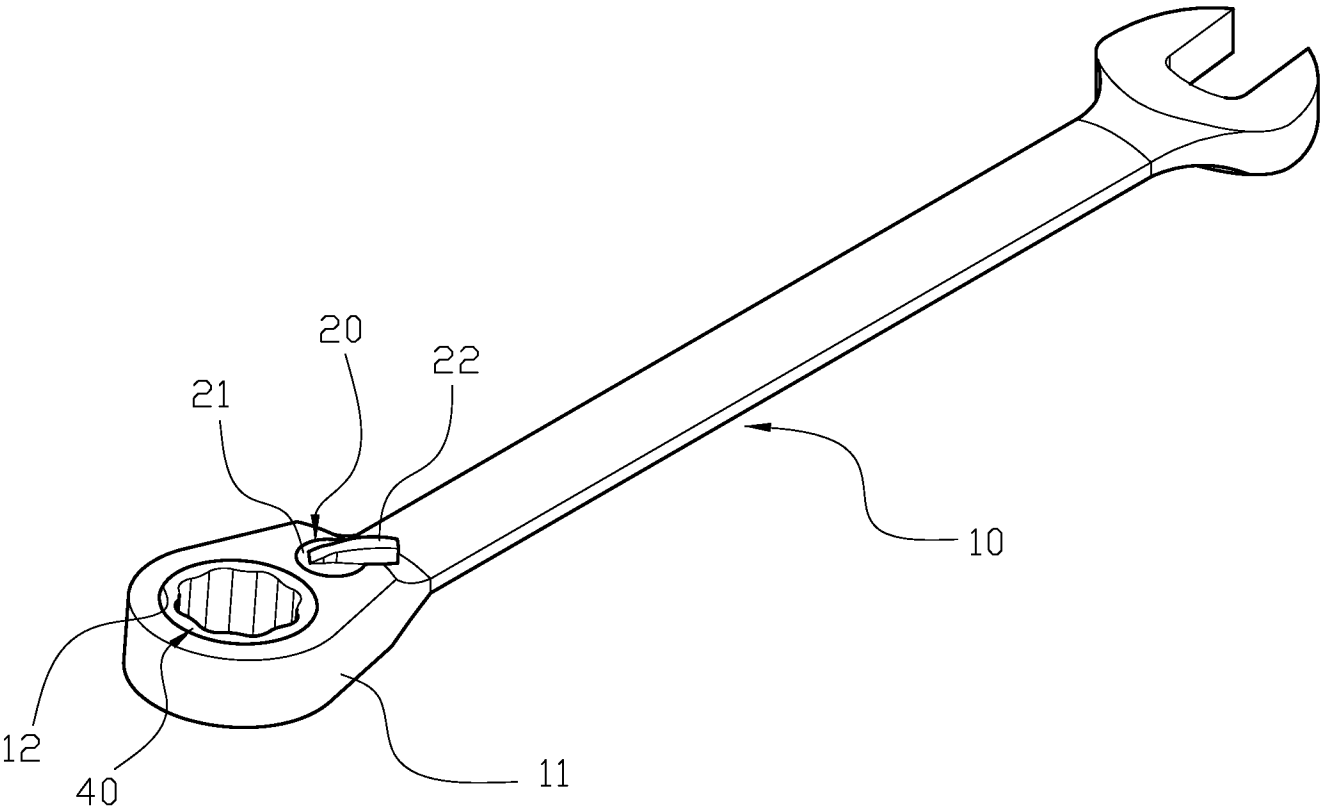
FIG. 1 illustrates a three-dimensional view of the present invention.
Figure 2:
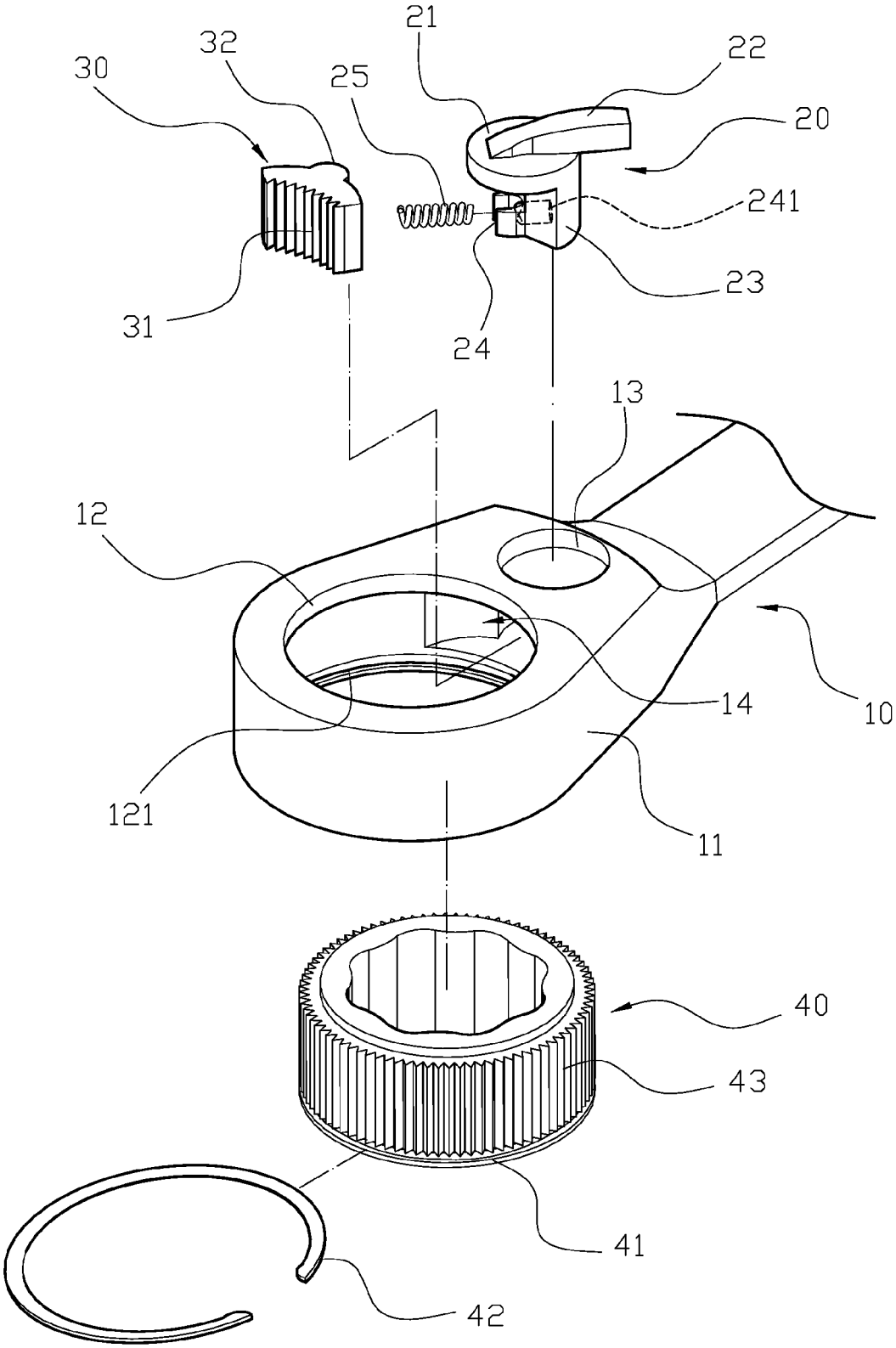
FIG. 2 illustrates a three-dimensional exploded view of the present invention.
Figure 3:
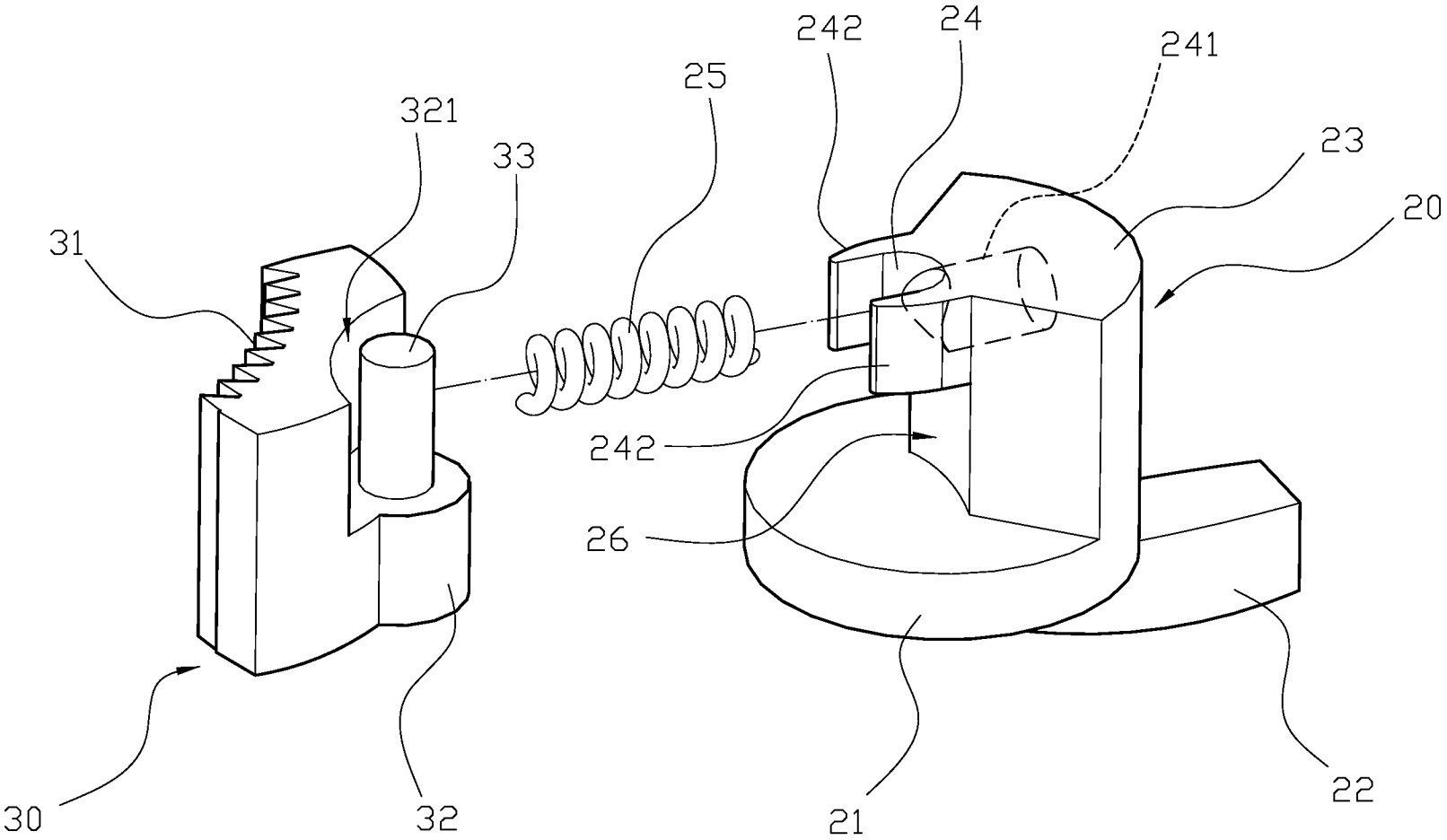
FIG. 3 illustrates a schematic view of the ratchet unit and control unit in the present invention.
Figure 4:
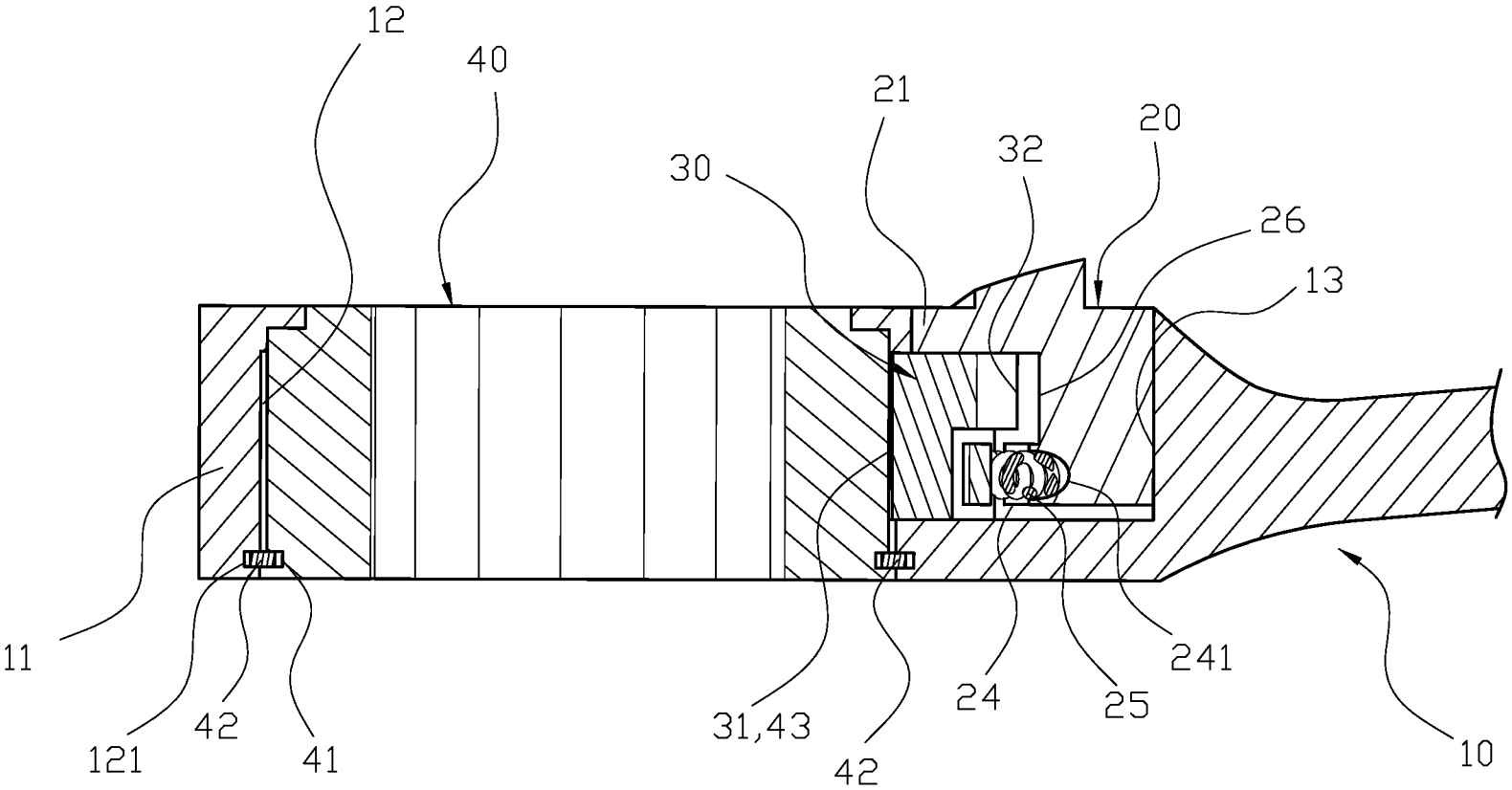
FIG. 4 illustrates a sectional view of the present invention.
Figure 6:
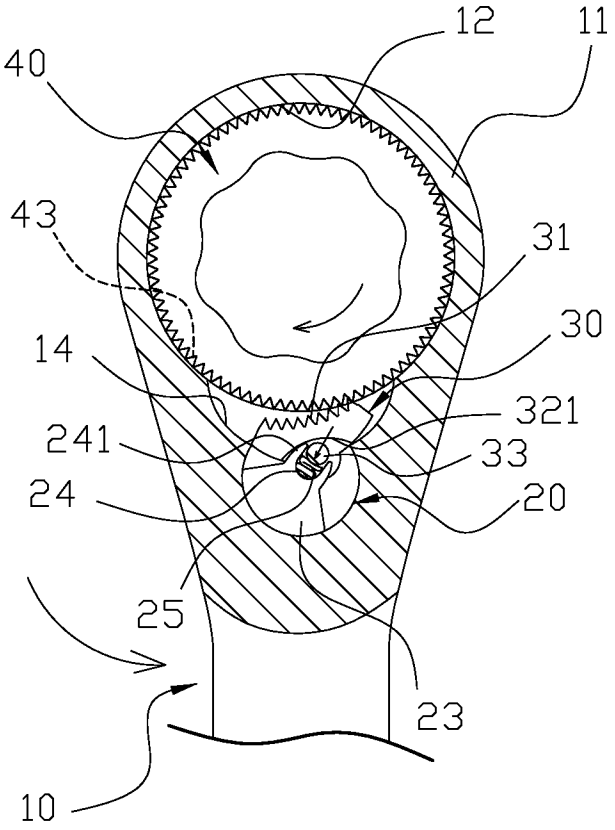
FIG. 6 illustrates another schematic view of the control unit moving in a clockwise manner in the present invention.
Figure 5:
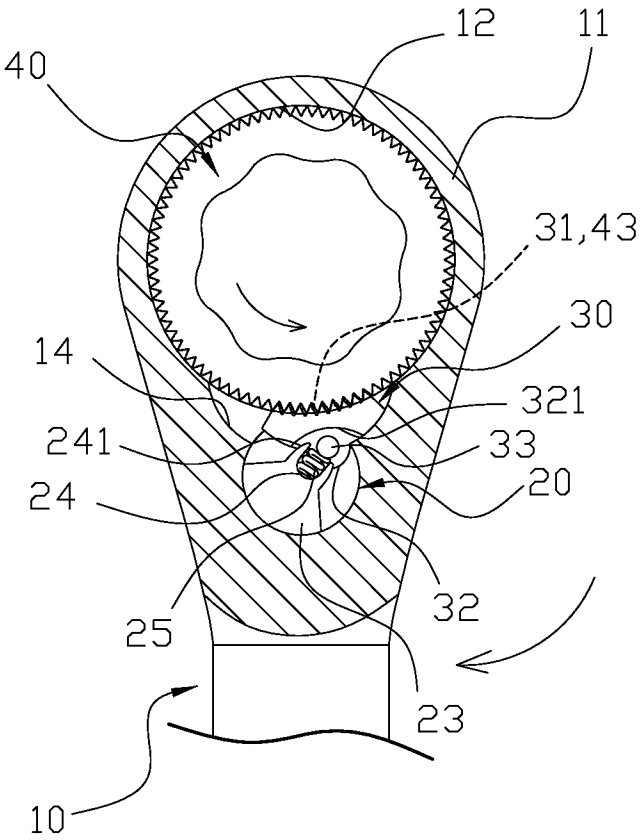
FIG. 5 illustrates the schematic view of the control unit moving in a clockwise manner in the present invention.
Figure 8:
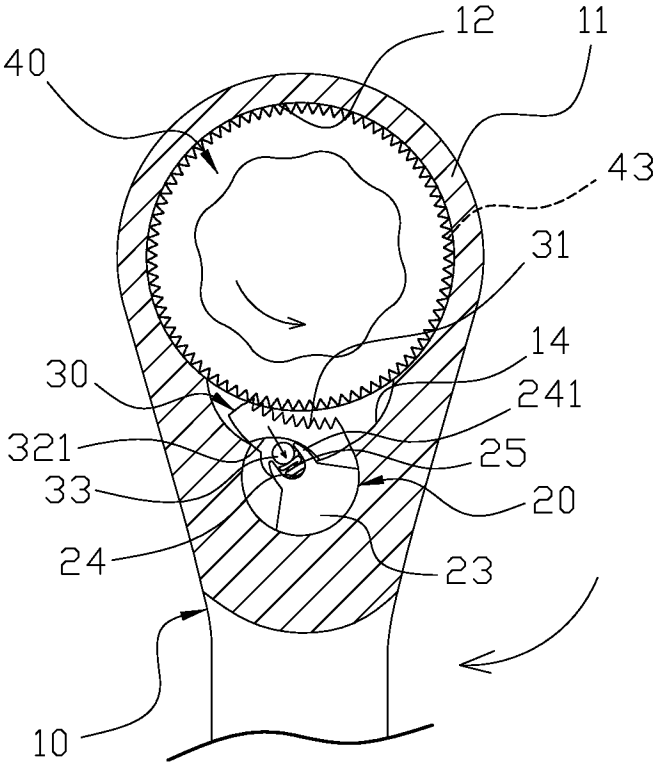
FIG. 8 illustrates another schematic view of the control unit moving in a counter-clockwise manner in the present invention.
Figure 7:
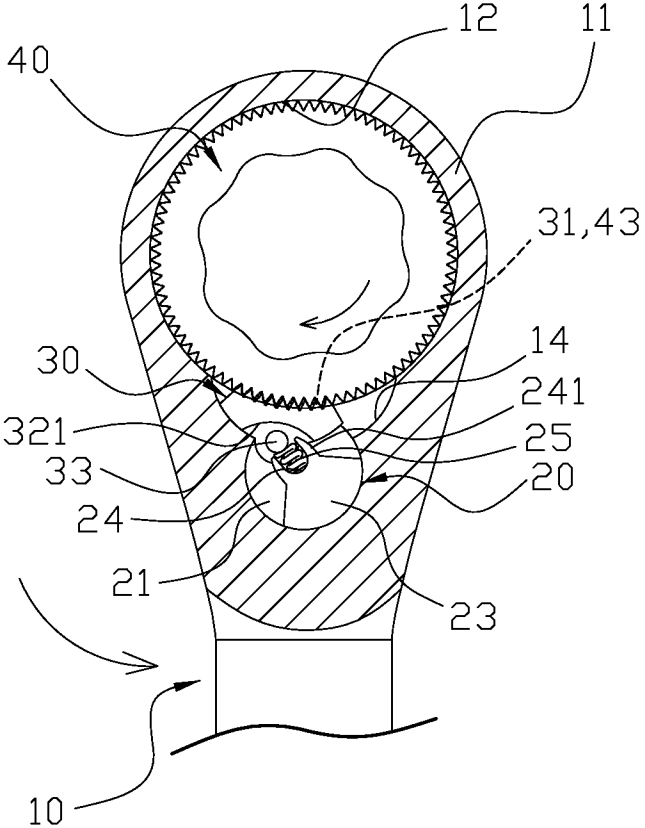
FIG. 7 illustrates the schematic view of the control unit moving in a counter-clockwise manner in the present invention.
Figure 9:
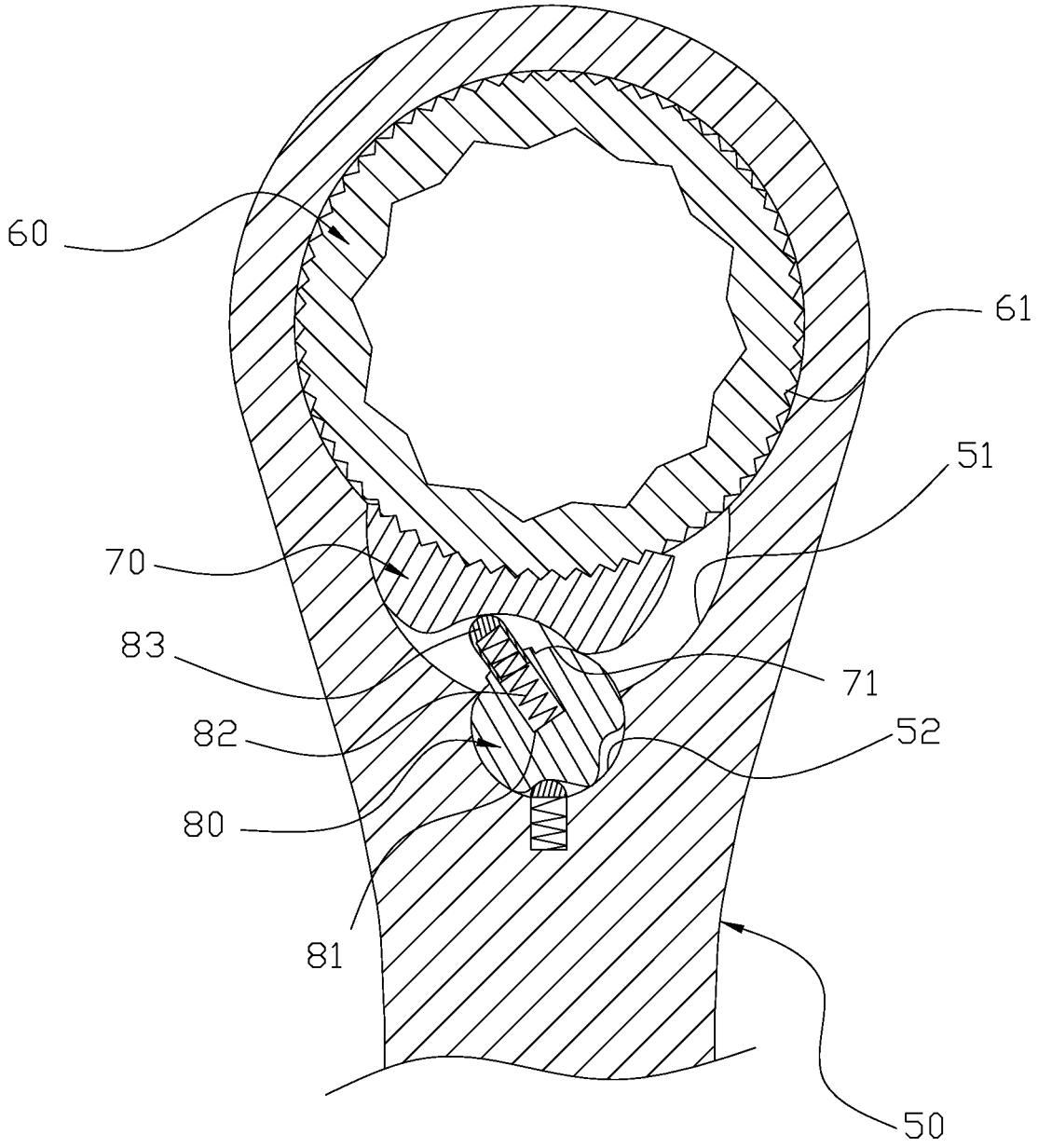
FIG. 9 PRIOR ART
FIG. 9 illustrates a sectional view of a conventional ratchet wrench.

In order to further understand the goal, characteristics and effect of the present invention, a number of embodiments along with the drawings are illustrated as following:

Referring to FIGS. 1 to 3, a reversible ratchet wrench includes a wrench body (10), a control unit (20), a ratchet unit (30) and a rotating unit (40). One end of the wrench body (10) has a ratchet portion (11) which has an activating opening (12) and a circular hole (13), and an arc ratchet slot (14) is formed between the activating opening (12) and circular hole (13). Furthermore, a fixed slot (121) is formed at inner portion of the activating opening (12). A control unit (20) has a circular plate portion (21), one end of which extends to form a handle unit (22), while the other end of which forms a block unit (23). A U-shaped base (24) is formed at the top portion of the block unit (23) and a spring (25) is formed at the U-shaped base (24), and a restricting gap (26) is recessedly formed between the circular plate portion (21) and the U-shaped base (24). The control unit (20) is disposed at the circular hole (13) of the wrench body (10) to expose the handle unit (22), and the U-shaped base (24) of the control unit (20) and the restricting gap (26) are facing the ratchet slot (14). A positioning hole (241) is formed at the opening of the U-shaped base (24) of the control unit (20) to secure the spring (25). One end of the ratchet unit (30) has arc teeth (31), the other end of which has a protruding restricting portion (32), and a column (33) protrudingly extends from one end of the restricting portion (32), and the restricting portion (32) and the column (33) are either formed as one unit or secured in a plugging manner. The ratchet unit (30) is disposed in the ratchet slot (14) of the wrench body (10) and the arc teeth (31) of the ratchet unit (30) faces the activating opening (12), and the restricting portion (32) is disposed in the restricting gap (26) of the control unit (20) and the column (33) is against the spring (25) of the control unit (20). U-shaped base (24) forms an arc surface (242) at outer periphery of the spring (25), and the ratchet unit (30) forms an arc space (321) near the column (33), so an evading effect between the ratchet unit (30) and the U-shaped base is generated using the arc space (321) and the arc surface (242). A ring slot (41) is recessedly formed at outer periphery of the rotating unit (40) and a C-shaped conjugating unit (42) is conjugated with the ring slot (41), and the C-shaped conjugating unit (42) conjugates with the fixed slot (121) of the activating opening (12) to secure the wrench body (10) and the rotating unit (40). A teeth ring (43) is formed at the outer periphery of the rotating unit (40) to engage with the arc teeth (31) of the ratchet unit (30).

Referring to FIGS. 2 to 5 for the structure of the present invention, the spring (25) is disposed at the positioning hole (241) of the U-shaped base (24), so that the spring (25) is slightly protruding from the U-shaped base (24). The block unit (23) of the control unit (20) is disposed into the circular hole (13) of the wrench body (10), so that the handle unit (22) of the control unit (20) exposes at the outer portion of the wrench body (10). The U-shaped base (24), spring (25) and the restricting gap (26) are all facing the ratchet slot (14), and the ratchet unit (30) is disposed into the ratchet slot (14) through the activating opening (12) of the wrench body (10), so that the restricting portion (32) of the ratchet unit (30) is disposed at the restricting gap (26) of the control unit (20). Furthermore, the column (33) is pressing one end of the spring (25), so the spring (25) is disposed and pressed between the column (33) and the positioning hole (241), and both sides of the spring (25) are restricted by the U-shaped base (24). Meanwhile, the control unit (20) is blocked by the restricting portion (32) of the ratchet unit (30), so that the control unit (20) cannot be taken out from the circular hole (13). Finally, the rotating unit (40) is disposed at the activating opening (12) of the wrench body (10), and the C-shaped conjugating unit (42) conjugates with the ring slot (41) of the rotating unit (40) and the fixed slot (121) of the activating opening (12) to complete the conjugation of the wrench body (10) and the rotating unit (40). Furthermore, a teeth ring (43) of the rotating unit (40) engages with the arc teeth (31) of the ratchet unit (30) to conjugate the wrench body (10) and the ratchet unit (30).

Referring to FIGS. 2, 3, 5 and 6, when the wrench is in use, the control unit (20) uses the spring (25) of the U-shaped base (24) to be sideway against the column (33) of the ratchet unit (30), so that the ratchet unit (30) is disposed at one side of the ratchet slot (14), and the arc teeth (31) of the ratchet unit (30) engage with the teeth ring (43) of the rotating unit (40). Under such circumstances, both sides of the spring (25) are clamped by the positioning hole (241) and the column (33) and both side of the spring (25) are blocked by the U-shaped base (24), so when the control unit (20) is operated, the spring (25) will not be deformed or pops out. When the control unit (20) is operated in a clockwise manner through the handle unit (22), it generates a reaction force through the rotating unit (40) and the teeth ring (43) of the rotating unit (40) drives the arc teeth (31) of the ratchet unit (30) in a counter-clockwise manner, so the ratchet unit (30) is pressed to be against one side of the ratchet slot (14) to tighten a nut or bolt. When further rotating the wrench body (10) in a counter-clockwise manner, a reaction force is generated so that the teeth ring (43) of the rotating unit (40) drives the arc teeth (31) of the ratchet unit (30) in a clockwise manner. With the resilience of the spring (25) and one side of the ratchet slot (14) is empty, the ratchet unit (30) sideway moves to the control unit (20) and the column (33) of the ratchet unit (30) moves into the U-shaped base (24), so the rotating unit (40) and the ratchet unit (30) are separated. Also, the ratchet unit (30) is pushed by the spring (25) to generate a back-and-forth movement to achieve the effect of tightening a nut or bolt.

On the contrary, when the control unit (20) is switched to a counter-clockwise mode through the handle unit (22), rotating the wrench body (10) in a counter-clockwise manner can make the rotating unit (40) to generate a reaction force, so the teeth ring (43) of the rotating unit (40) can push the arc teeth (31) of the ratchet unit (30) clockwise, and the ratchet unit (30) can be pressed and against one side of the ratchet slot (14) to loosen the nut or bolt. Furthermore, when rotating the wrench body (10) clockwise, the teeth ring (43) of the rotating unit (40) drives the arc teeth of the ratchet unit (30) counter-clockwise, and with the resilience of the spring and one side of the ratchet slot (14) being empty, the ratchet unit (30) moves sideway toward the control unit (20) to achieve the goal of unidirectionally loosening the nut or bolt.

According to the embodiments described above, the present invention is advantageous because (i) a column (33) is formed at the restricting portion (32) of the ratchet unit (30), and the column (33) is against one end of the spring (25) to link the ratchet unit (30) and the control unit (20); and both sides of the spring (25) are blocked by the U-shaped base (24), so when the control unit (20) is operated, the spring (25) will not be deformed or pops out to enhance the stability of the structure; (ii) the spring (25) is directly plugged into the positioning hole (241) of the control unit (20) and the U-shaped base (24) blocks both sides of the spring (25), so the block unit (23) of the control unit (20) can be inserted into the circular hole (13) of the wrench body (10). Also, the ratchet unit (30) is disposed into the ratchet slot (14) through the activating opening (12), the restricting portion (32) of the ratchet unit (30) plugs into the restricting gap (26) of the control unit (20), and the column (33) is against one end of the spring (25) to easily complete the assembly process of the wrench body (10); (iii) the U-shaped base (24) forms an arc surface (242) at outer periphery of the spring (25), and the ratchet unit (30) forms an arc space (321) near the column (33), so an evading effect between the ratchet unit (30) and the U-shaped base is generated using the arc space (321) and the arc surface (242). Namely, the distance between the ratchet unit (30) and the control unit (20) is shortened, so that the U-shaped based can be used to block both sides of the column (33) to enhance the positioning effect of the ratchet unit (30).

Having described the invention by the description and illustrations above, it should be understood that these are exemplary of the invention and are not to be considered as limiting. Accordingly, the invention is not to be considered as limited by the foregoing description, but includes any equivalents.

What is claimed is:

1. A reversible ratchet wrench comprising:

a wrench body, one end of which having a ratchet portion that has an activating opening and a circular hole, and an arc ratchet slot formed between the activating opening and circular hole;

a control unit having a circular plate portion, one end of which extending to form a handle unit, while the other end of which forming a block unit, and a U-shaped base formed at the top portion of the block unit and a spring is disposed at the U-shaped base, wherein a restricting gap is recessedly formed between the circular plate portion and the U-shaped base, and the control unit is disposed at the circular hole of the wrench body to expose the handle unit, and the U-shaped base of the control unit and the restricting gap are facing the ratchet slot;

a ratchet unit, one end which having arc teeth, the other end of which having a protruding restricting portion with a vertical height, and a column protrudingly extending from one end of the restricting portion, wherein the ratchet unit is disposed in the ratchet slot of the wrench body and the arc teeth of the ratchet unit faces the activating opening, and the restricting portion is disposed in the restricting gap of the control unit and the column is used to be against the spring of the control unit; and a rotating unit disposed at the activating opening of the wrench body, and a teeth ring formed at outer periphery of the rotating unit to engage with the arc teeth of the ratchet unit, wherein the restricting portion is monolithically formed on the ratchet unit, a bottom portion of the restricting portion rests on the circular plate portion, and an outwardly curved surface of the restricting portion engages with an inwardly curved surface of the restricting gap.

2. The reversible ratchet wrench of claim 1, wherein a fixed slot is formed at inner portion of the activating opening, and a ring slot is recessedly formed at outer periphery of the rotating unit and a C-shaped conjugating unit is conjugated with the ring slot, and the C-shaped conjugating unit conjugates with the fixed slot of the activating opening to secure the wrench body and the rotating unit.

3. The reversible ratchet wrench of claim 1, wherein a positioning hole is formed at the opening of the U-shaped base of the control unit to secure the spring.

4. The reversible ratchet wrench of claim 1, wherein the restricting portion of the ratchet unit and the column are secured in a plugging manner.

5. The reversible ratchet wrench of claim 1, wherein the U-shaped base has an arc surface at outer periphery of the spring, and the ratchet unit has an arc space near the column, so an evading effect between the ratchet unit and the U-shaped base is generated using the arc space and the arc surface.

* * * * *